US006164992A

United States Patent [19]

Okabe

[11] Patent Number: 6,164,992

[45] Date of Patent: Dec. 26, 2000

[54] STRUCTURE OF LEVER OF LEVER ENGAGEMENT TYPE CONNECTOR

[75] Inventor: Toshiaki Okabe, Shizuoka, Japan

[73] Assignee: Yazaki Corporation, Tokyo, Japan

[21] Appl. No.: 09/291,210

[22] Filed: Apr. 14, 1999

[30] Foreign Application Priority Data

Apr. 14, 1998 [JP] Japan ..... 10-102986

[51] Int. Cl.[7] ..... H01R 13/62

[52] U.S. Cl. ..... 439/157

[58] Field of Search ..... 439/157, 160, 439/372

[56] References Cited

U.S. PATENT DOCUMENTS 5,330,411 7/1994 Fujitani et al. .
5,711,682 1/1998 Maejima ..... 439/157

FOREIGN PATENT DOCUMENTS 0 654 862 A2 5/1995 European Pat. Off. .
DE 43 34 929 C2 4/1994 Germany .
6-124747 5/1994 Japan ..... H01R 13/629
6-140098 5/1994 Japan ..... H01R 13/631
6-302353 10/1994 Japan ..... H01R 13/629

*Primary Examiner*—Paula Bradley
*Assistant Examiner*—Briggitte R. Hammond
*Attorney, Agent, or Firm*—Sughrue, Mion, Zinn, Macpeak & Seas, PLLC

[57] ABSTRACT

When a lever attached to a male connector is rotated, the male connector is engaged with a female connector. The lever includes: a pair of lever walls pivotally supported by both side walls of the male connector; protrusions to be engaged with the female connector, formed on one sides of the lever walls; and an operating portion for connecting ends of the lever walls on the other side. Rigidity is given to the lever by forming a rib zone, which is integrally bent toward the male connector, on the pair of lever walls and the operating portion.

2 Claims, 3 Drawing Sheets

STRUCTURE OF LEVER OF LEVER ENGAGEMENT TYPE CONNECTOR

BACKGROUND OF THE INVENTION

1. Field of the Invention

The present invention relates to a structure of a lever of a lever engagement type connector in which the connector is engaged with a mating connector by rotating the lever attached to the connector.

2. Description of the Related Art

FIGS. 3, 4(*a*) and 4(*b*) are views showing a conventional lever engagement type connector. As shown in the drawings, the conventional lever engagement type connector includes: a female connector 1; a male connector 2 which is engaged with the female connector 1; and a lever 3 for engaging the male connector 2 with the female connector 1. Inside the female and male connectors 1 and 2, there are provided terminals (not shown) which are contacted and electrically communicated when the male connector 2 is engaged with the female connector 1. The female connector 1 is provided with an insertion hole 4 with which the male connector 2 is engaged. Reference numeral 10 designates electric wires which are connected with the terminals provided in the male connector 2 and drawn out from the male connector 2. In both side walls 1*a* of the female connector 1, there are formed introducing slits 6 for introducing pins 5 which protrude from both side walls of the male connector 2. Further, on both side walls 1*a* of the female connector 1, there are provided bosses 6*a* to which the lever 3 is pivotally attached, wherein these bosses 6*a* protrude from the side walls 1*a*.

The lever 3 includes: lever walls 3*a* which are respectively arranged on the right and the left; and an operating portion 3*b* which connects the right lever wall 3*a* with the left lever wall 3*a*, wherein these lever walls 3*a* and the operating portion 3*b* are formed into a U-shape when viewed from the front. In each lever wall 3*a*, there is formed a rotary hole 7 into which the boss 6*a* of the female connector 1 is inserted. When the boss 6*a* is inserted into the rotary hole 7, the lever 3 can be pivotally supported by the female connector 1. In each lever wall 3*a* of the lever 3, there is formed a cam groove 8 into which the pin 5 of the male connector 2 is drawn. When the pin 5 of the male connector 2 is drawn into the cam groove 8, the male connector 2 is drawn into the female connector 1 from the insertion hole 4. In this way, the male connector 2 is engaged with the female connector 1.

As shown in FIG. 4(*a*), in the connector having the above structure, the lever 3 is raised so that the cam groove 8 can be directed to the male connector 2, and the male connector 2 is made to come close to the female connector 1. Then the pin 5 is inserted into the introducing slit 6. Under the above condition, the operating portion 3*b* is pressed by an operator's finger 9 as shown in FIG. 4(*b*), so that the lever 3 can be rotated clockwise. The cam groove 8 of the lever 3 draws the pin 5 in the above rotation. Therefore, it becomes possible to engage the male connector 2 with the female connector 1. On the other hand, in order to draw out the male connector 2 from the female connector 1, the operating portion 3 is rotated counterclockwise, so that the pin 5 can be pushed out to the exit of the cam groove 8.

In the connector of the above structure, the following problems may be encountered. The rigidity of the lever 3 must be high for the prevention of deformation of the lever 3 when an operational force acts on the lever 3 when the male connector 2 is engaged with or disengaged from the female connector 1. In the case where the rigidity is low, the lever 3 is deformed and disconnected from the female connector 1, and further the lever 3 is cracked and damaged. Therefore, the wall thickness of the lever wall 3*a* and that of the operating portion 3*b* are respectively increased in the conventional connector so that the entire lever 3 can be given high rigidity.

However, when the wall thickness of the entire lever 3 is increased, a large space to arrange the lever is required in the connector. Therefore, it becomes difficult to reduce the size of the entire connector, and further the weight of the connector is increased. Furthermore, since the lever 3 becomes heavy, it is difficult to operate the lever.

SUMMARY OF THE INVENTION

It is an object of the present invention to provide a structure of a lever of a lever engagement type connector in which the rigidity of the lever can be enhanced without increasing the wall thickness of the lever, so that the size and weight of the entire connector can be reduced and the operability can be enhanced.

In order to accomplish the above object, the invention provides a lever of a lever engagement type connector in which the connector is engaged with an mating connector by rotating the lever attached to the connector, the lever comprising: a pair of lever walls which are pivotally supported by both side walls of the connector; protrusions formed on one sides of the lever walls, the protrusions engaging with the mating connector; an operating portion which connects the other sides of the lever walls; and a rib zone formed in the pair of lever walls and the operating portion in such a manner that the rib zone is integrally bent to the side of the connector.

In this invention, the operating portion is operated so as to rotate the lever under the condition that the engaging portion of the lever is engaged with the mating connector and that the pair of lever walls are pivotally supported by both side walls of the connector. In the above rotation of the lever, the protrusion functions as a fulcrum and the operating portion functions as a point of force. Therefore, the connector can be engaged with the mating connector by the above lever action even if a low intensity of force is given to the operating portion.

In the lever of the present invention, the rib zone is integrally formed on the pair of lever walls and the operating portion. Therefore, the rigidity of the lever walls and the operating portion is enhanced by the rib zone. Accordingly, it is possible to prevent deformation and damage of the lever when the lever is operated. For the above reasons, it is unnecessary to increase the wall thickness of the entire lever. Therefore, the size and weight of the connector can be reduced. Since the weight of the connector is small, the operability can be enhanced as well.

BRIEF DESCRIPTION OF THE DRAWINGS

FIG. 2(*b*) is a side view showing a state in which the male connector is engaged with a female connector by operating the lever;

DETAILED DESCRIPTION OF THE PREFERRED EMBODIMENT

Figure 1:
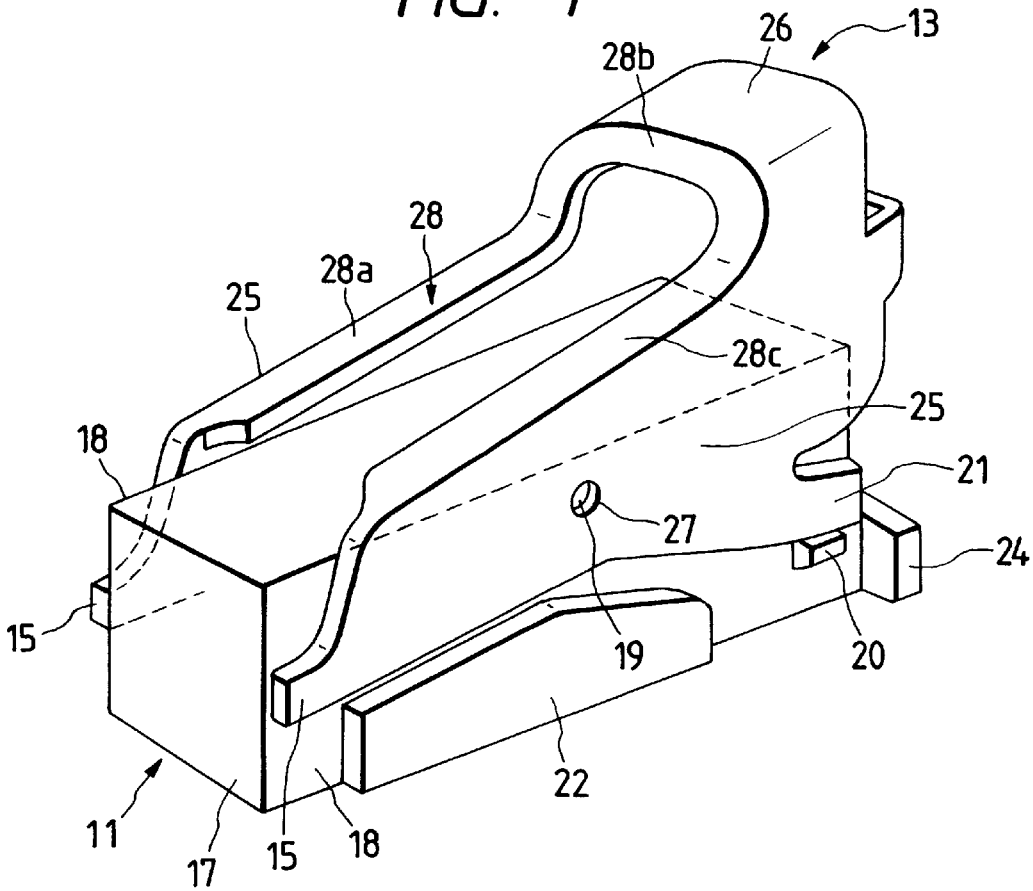
FIG. 1 is a perspective view of a lever engagement connector of an embodiment of the present invention.
Figure 3:
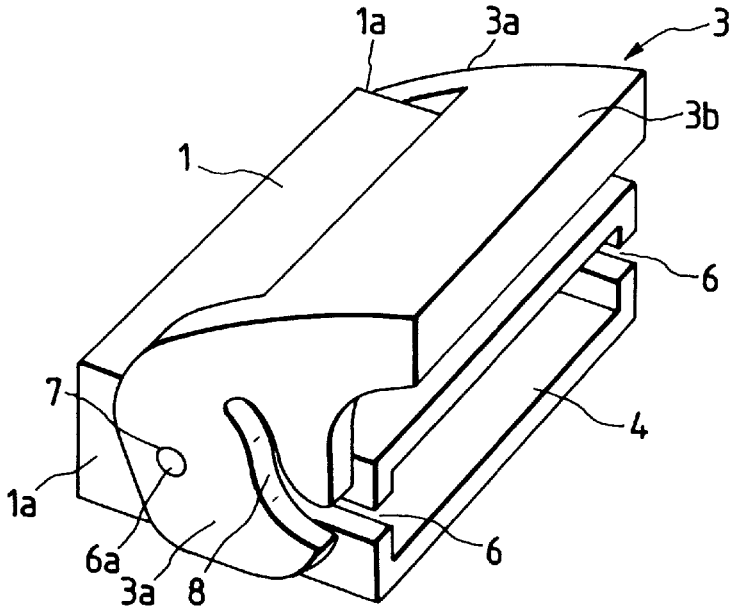
FIG. 3 PRIOR ART
FIG. 3 is a perspective view of a conventional lever engagement type connector.
Figure 2A:
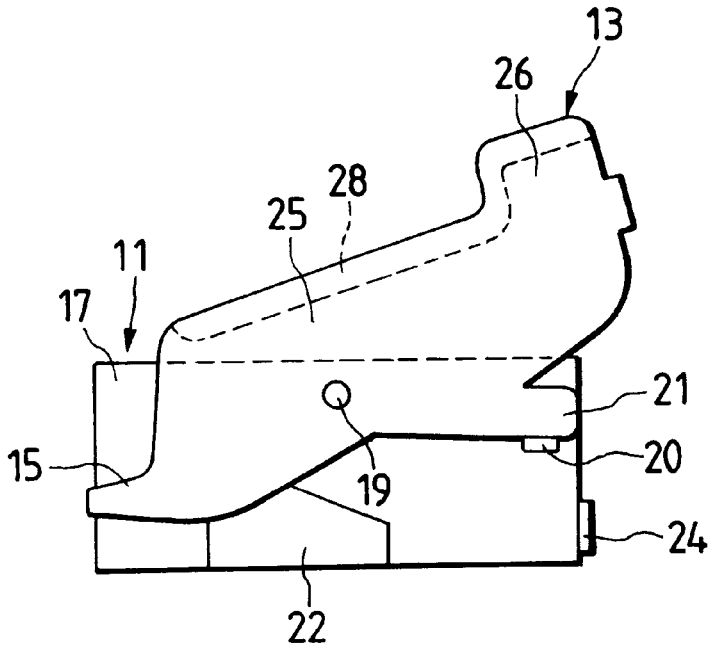
FIG. 2(*a*) is a side view showing a state in which a lever is attached to a male connector.
Figure 2B:
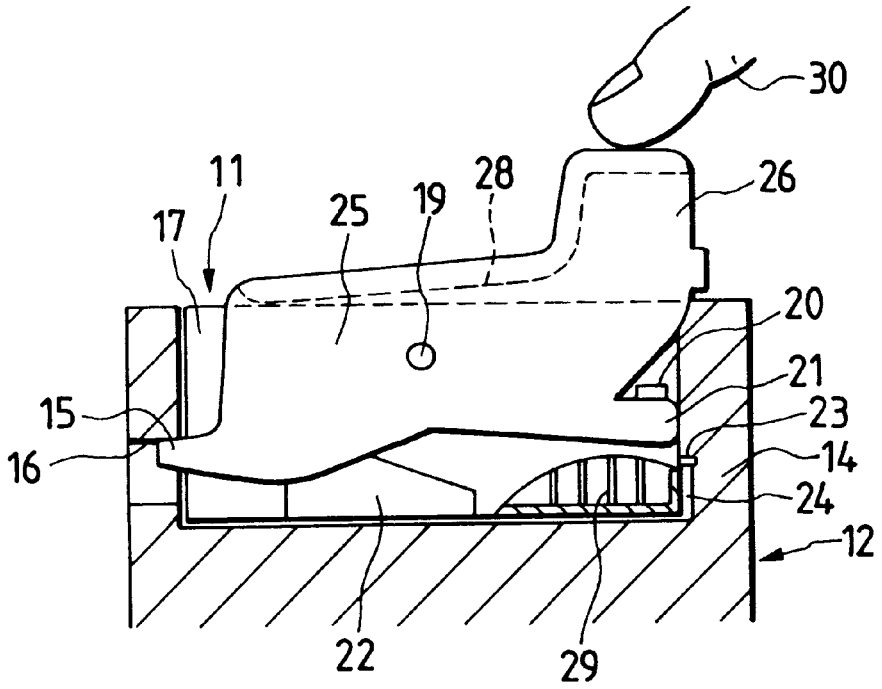
Figure 4A:
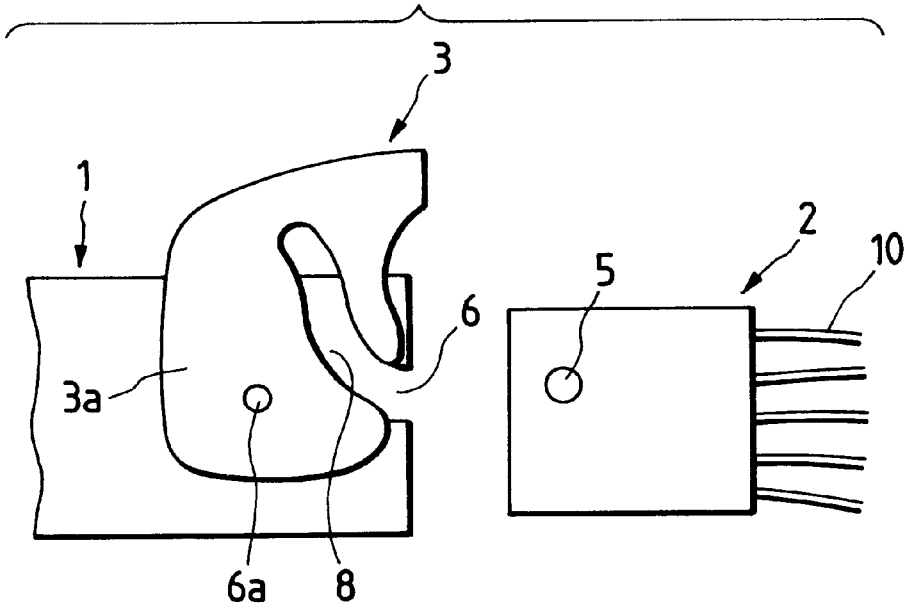
FIG. 4(a) PRIOR ART
FIGS. 4(*a*) and 4(*b*) are side views showing a procedure by which the conventional lever engagement type connector is assembled.
Figure 4B:
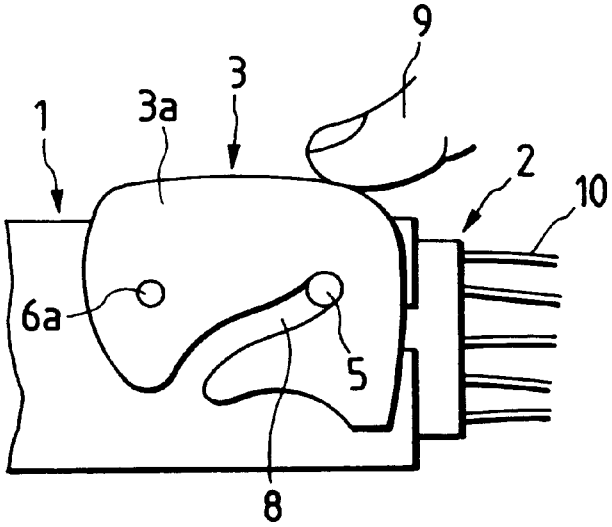
FIG. 4(b) PRIOR ART

FIGS. 1, 2(*a*) and 2(*b*) are views showing a lever engagement type connector of an embodiment of the present invention. The connector includes: a male connector 11 which is the connector; a female connector 12 which is a mating connector with which the male connector 11 is engaged; and a lever 13 by which the male connector 11 is engaged with the female connector 12.

On an upper surface of the female connector 12, there is provided a square frame-shaped hood 14 which rises from the upper surface. The male connector 11 is engaged with this hood 14. Inside the male connector 11 and the female connector 12, there are provided a plurality of terminals which are electrically communicated with each other when both connectors 11 and 12 are engaged with each other. As shown in FIG. 2(*b*), a plurality of mating terminals 29 rise from the inside of the female connector 12 within the hood 14. In the bottom wall of the male connector 11, there are provided a plurality of terminal holes (not shown) into which the mating terminals are inserted. There are provided terminals (not shown) of the male connector 11 in the terminal receiving chambers (not shown) which are communicated with these terminal holes. In the hood 14 of the female connector 12, there is formed an engagement hole 16 in which a protrusion 15, which will be described later, of the lever 13 is engaged as shown in FIG. 2(*b*).

The male connector 11 is provided with a connector body 17, the profile of which is a rectangular box shape, inside which terminals are accommodated. At the substantial centers in the longitudinal direction of both side walls 18, 18 of the connector body 17, there are provided bosses 19, 19, the profile of which is a column shape. The lever 13 is pivotally supported by these bosses 19, 19. There are provided engaging protrusions 20, 20 at positions distant from the bosses 19, 19 on both side walls 18, 18 of the connector body 17. When these engaging protrusions 20, 20 are engaged with engaging pieces 21, 21 of the lever 13 which will be described later, the lever 13 can be temporarily engaged with the connector body 17.

Below the bosses 19, 19 of both side walls 18, 18 of the connector body 17, there are provided protruding portions 22 for preventing the lever 13 from being rickety. Further, on the side of the engaging protrusion 20 of the connector body 17, there is provided an engaging piece 24 which is engaged with an engaging groove 23 (shown in FIG. 2(*b*)) formed in the hood 14 of the female connector 12.

The lever 13 includes: a pair of lever walls 25, 25, which are arranged on the right and the left, attached to the connector body 17 in such a manner that both side walls 18, 18 of the connector body 17 are interposed between the lever walls 25, 25; protrusions 15, 15 arranged on one sides of the lever walls 25, 25; and an operating portion 26 for connecting the other sides of the lever walls 25, 25.

In the pair of lever walls 25, 25, there are formed rotary holes 27 for pivotally supporting the lever 13 when the bosses 19, 19 of the connector body 17 are inserted into the rotary holes 27, so that the lever 13 can be pivotally supported by the male connector 11. When the protrusions 15, 15 formed on the one sides of the lever walls 25, 25 are engaged with the engaging hole 16 formed in the hood 14 of the female connector 12, these protrusions 15, 15 become fulcrums which are used when the male connector 11 is engaged with the hood 14.

The operating portion 26 becomes a point of force when the connector 11 is engaged with the hood 14. When a pushing force is given to this operating portion 26, the pair of lever walls 25, 25 are rotated about the bosses 19, 19. This operating portion 26 is formed in such a manner that the pair of lever walls 25, 25 are connected with each other on the other side of them. Due to the above structure, the pushing force can be uniformly given to both lever walls 25, 25. Further, on the lower side of the operating portion 26, there are provided engaging pieces 21, 21 to be engaged with the engaging protrusions 20, 20 of the connector body 17.

In the above lever 13, there is provided a rib zone 28 on the pair of lever walls 25, 25 and the operating portion 26 which connects the lever walls 25, 25. The rib zone 28 is formed in such a manner that the lever walls 25, 25 and the operating portion 26 are bent toward the male connector 11. In the embodiment shown in the drawings, the rib zone 28 is formed in such a manner that upper end portions of the lever walls 25, 25 and an end portion of the operating portion 26 on the side of the lever wall 25 are bent into an L-shape. That is, this rib zone 28 is formed by integrally bending the pair of lever walls 25, 25 and the operating portion 26.

As shown in FIG. 1, this rib zone 28 includes: a first rib zone portion 28*a* formed by bending one of the lever walls 25 into an L-shape; a second rib zone portion 28*b* formed in the operating portion 26 arranged continuously to the end portion of the first rib zone portion 28*a;* and a third rib zone portion 28*c* formed in the other lever wall 25 arranged continuously to the second rib zone portion 28*b,* wherein the first, second and third rib zone portions are integrally formed.

Since the rib zone 28 is formed in such a manner that the pair of lever walls 25, 25 and the operating portion 26, which connects the lever walls 25, 25, are integrally bent, the entire lever 13 composed of the lever walls 25, 25 and the operating portion 26 are given high rigidity. Therefore, even if stress is given to the lever 13 when the male 11 connector is engaged to or disengaged from the female connector 12, deformation of the lever 13 can be prevented.

Next, the procedure of engagement of the connector of this embodiment will be described below. First, the connector body 17 of the male connector 11 is placed between the pair of lever walls 25, 25, and at the same time the bosses 19, 19 are inserted into the rotary holes 27. Due to the foregoing, the lever 13 is incorporated into the male connector 11. At this time, the protrusions 22, 22 for preventing the lever walls 25, 25 from being rickety come into contact with the lower end portions of the lever walls 25, 25 as shown in FIG. 2(*a*). Therefore, the lever 13 can be mounted on the male connector 11 without becoming rickety.

Then, the protrusions 15 of the lever 13 are inserted into the engaging hole 16 of the hood 14, and the operating portion 26 is pressed by an operator's finger 30 as shown in FIG. 2(*b*). When the operating portion 26 is pressed, the male connector 11 is rotated clockwise, wherein the operating portion 26 functions as a point of force, the protrusion 15 engaged with the engaging hole 16 functions as a fulcrum, and the boss 19 functions as a point of application. When the male connector 11 is rotated clockwise, the male connector 11 is engaged with the hood 14 of the female connector 12. In this case, the length from he engaging position of the protrusion 15 with the engaging hole 16 to the operating portion 26 is substantially twice as long as the length from the engaging posit-on of the protrusion 15 with the engaging hole 16 to the boss 19. Accordingly, an intensity of force given to the operating portion 26 is doubled when it is given to the male connector 1 via the boss 19. Consequently, engagement of the male connector 11 with the female connector 12 can be conducted by a low intensity of force.

Simultaneously with this engagement of the male connector 11 with the female connector 12, the engaging piece 24 of the male connector 11 is engaged with the engaging groove 23 of the hood 14. Therefore, the male connector 11 can be stably engaged with the female connector 12. Since the engaging piece 21 of the lever 13 gets over and engages with the engaging protrusion 20, it is possible to prevent the lever 13 from being disengaged carelessly.

On the other hand, in order to disengage the male connector 11 from the hood 14 of the female connector 12, the operating portion 26 of the lever 13 is operated in the opposite direction. Due to the foregoing, the lever 13 is rotated in the opposite direction, and the male connector 11 is disengaged from the hood 14 of the female connector 12.

As described above, in this embodiment, the rib zone 28 is integrally formed on the pair of lever walls 25, 25 of the lever 13 by which the male connector 11 is engaged with or disengaged from the female connector 12, and also the rib zone 28 is integrally formed on the operating portion 26 connecting the lever walls 25, 25. Accordingly, rigidity of the entire lever 13 can be enhanced. Due to the above arrangement, there is no possibility that the lever is deformed and damaged. Also, there is no possibility that the lever walls 25, 25 are opened in the process of engagement or disengagement. Accordingly, the lever 13 is not disconnected carelessly.

Since the rigidity of the lever 13 is enhanced, the wall thickness of the entire lever can be reduced. Therefore, a space occupied by the lever 13 in the connector can be reduced, and the size and weight of the connector can be reduced. Since the weight of the lever 13 is small, it is possible to operate the lever lightly. Therefore, the operability can be enhanced as well.

As described above, according to the invention, since the rib zone is integrally formed on the pair of lever walls and the operating portion, the rigidity of the entire lever is enhanced. Therefore, when the lever is operated, there is no possibility that the lever is deformed or damaged. Therefore, it is unnecessary to increase the wall thickness of the lever, and the size and weight of the connector can be reduced. Since the weight of connector is small, the operability of the lever can be enhanced as well.

What is claimed is:

1. A lever of a lever engagement type connector in which the connector is engaged with a mating connector by rotating said lever attached to the connector, said lever comprising:

a pair of lever walls which are pivotally supported by both side walls of the connector;

protrusions formed at one end of the lever wall, the protrusions engaging with the mating connector;

an operating portion which connects an other end of the lever walls; and a plurality of ribs respectively extending substantially perpendicularly from a side of the pair of lever walls and of the operating portion.

2. The lever according to claim 1, wherein the plurality of ribs includes a first rib formed by bending one of the lever walls into an L-shape; a second rib formed in the operating portion arranged continuously to an end portion of the first rib; and a third rib formed in the other lever wall arranged continuously to the second rib.

* * * * *